US010641018B2

(12) United States Patent
Dow et al.

(10) Patent No.: US 10,641,018 B2
(45) Date of Patent: May 5, 2020

(54) LATCH WITH SPRING FOR BELL CRANK LEVER

(71) Applicants: Ian Dow, Bloomfield, MI (US); John R. Rice, New Baltimore, MI (US); Donald M. Perkins, Sterling Heights, MI (US)

(72) Inventors: Ian Dow, Bloomfield, MI (US); John R. Rice, New Baltimore, MI (US); Donald M. Perkins, Sterling Heights, MI (US)

(73) Assignee: INTEVA PRODUCTS, LLC, Troy, MI (US)

( * ) Notice: Subject to any disclaimer, the term of this patent is extended or adjusted under 35 U.S.C. 154(b) by 144 days.

(21) Appl. No.: 14/724,167

(22) Filed: May 28, 2015

(65) Prior Publication Data

US 2015/0345189 A1 Dec. 3, 2015

Related U.S. Application Data

(60) Provisional application No. 62/006,018, filed on May 30, 2014, provisional application No. 62/006,025, filed on May 30, 2014.

(51) Int. Cl.
*E05B 81/06* (2014.01)
*E05B 81/14* (2014.01)
(Continued)

(52) U.S. Cl.
CPC ..... *E05B 81/06* (2013.01); *E05B 81/15* (2013.01); *E05B 81/34* (2013.01);
(Continued)

(58) Field of Classification Search
CPC ..... E05B 81/06; E05B 81/15; E05B 81/34; E05B 2015/0493; E05B 2015/0403;
(Continued)

(56) References Cited

U.S. PATENT DOCUMENTS 3,858,919 A * 1/1975 Kleefeld ..... E05B 83/367 292/216
3,969,789 A 7/1976 Wize
(Continued)

FOREIGN PATENT DOCUMENTS

CA 2893061 A1 5/2014
CN 1475646 A 2/2004
(Continued)

OTHER PUBLICATIONS

CN Office Action dated Feb. 12, 2018 for Application No. 201510293450.9.
(Continued)

*Primary Examiner* — Carlos Lugo
*Assistant Examiner* — Faria F Ahmad
(74) *Attorney, Agent, or Firm* — Cantor Colburn LLP

(57) ABSTRACT

A latch having: a fork bolt; a detent lever; and a bell crank lever, wherein the bell crank lever moves the detent lever from a latched position to a released position as the bell crank lever moves from a first position to a second position; and an over center spring secured to the bell crank lever at one end and a portion of a housing of the latch at another end, wherein the over center spring is configured to provide a biasing force to the bell crank lever in a first direction towards first position when the bell crank lever is in the first position and the over center spring is configured to provide a biasing force to the bell crank lever in a second direction towards the second position when the bell crank lever is in the second position.

17 Claims, 7 Drawing Sheets

(51) Int. Cl.
*E05B 81/34* (2014.01)
*E05B 15/04* (2006.01)

(52) U.S. Cl.
CPC ..... *E05B 2015/0403* (2013.01); *E05B 2015/0493* (2013.01); *Y10T 29/49828* (2015.01); *Y10T 292/108* (2015.04); *Y10T 292/1047* (2015.04); *Y10T 292/1082* (2015.04); *Y10T 292/1092* (2015.04)

(58) Field of Classification Search
CPC ..... E05B 2015/0406; E05B 2015/041; E05B 2015/0413; E05B 2015/042; E05B 2015/0424; E05B 2015/0427; E05B 2015/0431; E05B 2015/00434; E05B 2015/0437; E05B 2015/0441; E05B 2015/0444; E05B 2015/0448; E05B 2015/0451; E05B 2015/0455; E05B 2015/0458; E05B 2015/0462; E05B 2015/0465; E05B 2015/0468; E05B 2015/0472; E05B 2015/0479; E05B 2015/0482; E05B 2015/0486; E05B 2015/0489; E05B 2015/0496; Y10T 292/1082; Y10T 292/1092; Y10T 292/1047
USPC ..... 292/201, 210, 216, DIG. 23
See application file for complete search history.

(56) References Cited

U.S. PATENT DOCUMENTS 5,020,838 A 6/1991 Fukumoto
5,154,460 A * 10/1992 Bartsch ..... E05B 83/36 292/216
5,181,754 A * 1/1993 Shibata ..... E05B 85/243 292/216
5,238,274 A * 8/1993 Becker ..... E05B 81/06 292/201
5,538,298 A * 7/1996 Ikeda ..... E05B 81/25 292/201
5,676,003 A * 10/1997 Ursel ..... E05B 77/26 292/201
5,906,123 A 5/1999 Spurr
5,979,951 A * 11/1999 Shimura ..... E05B 85/26 292/216
6,059,327 A * 5/2000 Yoshikuwa ..... E05B 83/16 292/216
6,109,079 A * 8/2000 Ikeda ..... E05B 81/06 292/201
6,126,212 A * 10/2000 Fujihara ..... E05B 85/243 292/216
6,343,817 B1 * 2/2002 Watanabe ..... E05B 77/30 292/201
6,371,536 B1 * 4/2002 Koerwer ..... E05B 81/14 292/201
6,378,920 B1 4/2002 Ostrowski et al.
6,511,106 B2 1/2003 Perkins et al.
6,540,272 B2 * 4/2003 Spurr ..... E05B 85/243 292/216
6,568,741 B1 5/2003 Leung
6,629,710 B1 * 10/2003 Shafry ..... B60N 2/01583 292/216
6,679,531 B2 1/2004 Rogers, Jr. et al.
6,705,649 B1 * 3/2004 Reddmann ..... E05B 81/06 292/201
6,913,298 B2 * 7/2005 Inoue ..... E05B 81/06 292/201
7,413,225 B2 * 8/2008 Spurr ..... E05B 17/007 292/201
7,434,852 B2 * 10/2008 Spurr ..... E05B 85/26 292/201
7,475,920 B2 * 1/2009 Bigazzi ..... E05B 81/14 292/201
8,342,581 B2 1/2013 Dow
8,348,310 B2 * 1/2013 Vazquez ..... E05B 85/26 292/216
8,522,583 B2 * 9/2013 Cumbo ..... E05B 81/06 292/201
8,757,679 B2 * 6/2014 Torkowski ..... E05B 81/14 292/201
8,864,209 B2 * 10/2014 White ..... B60N 2/065 296/65.01
8,876,176 B2 * 11/2014 Spurr ..... E05B 81/14 292/216
9,151,092 B2 * 10/2015 Scholz ..... E05B 85/26
10,119,306 B2 11/2018 Bendel et al.
2001/0005080 A1 * 6/2001 Inoue ..... E05B 77/24 292/216
2001/0024040 A1 * 9/2001 Spurr ..... E05B 85/243 292/216
2001/0024041 A1 * 9/2001 Barczynski ..... E05B 77/26 292/216
2002/0163207 A1 11/2002 Rogers, Jr. et al.
2002/0167178 A1 * 11/2002 Spurr ..... E05B 77/02 292/201
2004/0055407 A1 * 3/2004 Coleman ..... E05B 81/20 74/425
2004/0145191 A1 * 7/2004 Watanabe ..... E05B 83/36 292/216
2004/0174022 A1 * 9/2004 Inoue ..... E05B 81/06 292/216
2005/0212302 A1 * 9/2005 Fisher ..... E05B 81/14 292/216
2006/0012185 A1 * 1/2006 Kiehl ..... E05B 85/26 292/216
2008/0203737 A1 * 8/2008 Tomaszewski ..... E05B 77/26 292/216
2009/0160198 A1 * 6/2009 Yoda ..... E05B 81/06 292/201
2009/0322104 A1 * 12/2009 Nam ..... E05B 85/243 292/216
2010/0052336 A1 * 3/2010 Bendel ..... E05B 85/26 292/196
2010/0072761 A1 * 3/2010 Tomaszewski ..... E05B 77/26 292/201
2010/0127511 A1 * 5/2010 Vasquez ..... E05B 81/06 292/201
2010/0127512 A1 5/2010 Vazquez et al.
2011/0012376 A1 * 1/2011 Hunt ..... E05B 85/26 292/216
2011/0031765 A1 * 2/2011 Vazquez ..... E05B 85/26 292/217
2011/0101707 A1 * 5/2011 Perkins ..... E05B 81/06 292/199
2011/0204659 A1 8/2011 Estrada et al.
2011/0210565 A1 * 9/2011 Scholz ..... E05B 85/26 292/200
2011/0304162 A1 12/2011 Dow
2012/0292927 A1 11/2012 Vazquez et al.
2013/0099510 A1 * 4/2013 Dow ..... E05B 81/15 292/226
2013/0099511 A1 * 4/2013 Dow ..... E05C 3/22 292/226
2014/0292000 A1 10/2014 Vazquez et al.
2015/0084352 A1 * 3/2015 Barmscheidt ..... E05B 81/15 292/201
2016/0032626 A1 * 2/2016 Margheritti ..... E05B 77/32 292/220
2016/0153217 A1 6/2016 Mazal
2016/0160540 A1 * 6/2016 Bejune ..... E05B 77/06 292/196
2017/0191289 A1 7/2017 Perkins

(56) References Cited

U.S. PATENT DOCUMENTS

| | | | | |
|---|---|---|---|---|
| 2018/0223568 | A1 | 8/2018 | Cho et al. | |
| 2018/0313119 | A1* | 11/2018 | Taga | E05B 77/265 |

FOREIGN PATENT DOCUMENTS

| | | | |
|---|---|---|---|
| CN | 1673014 | A | 9/2005 |
| CN | 101065552 | A | 10/2007 |
| CN | 102199959 | A | 9/2011 |
| EP | 1256676 | A2 | 11/2002 |
| JP | 200813932 | A | 1/2008 |

OTHER PUBLICATIONS

CN Office Action dated Mar. 28, 2017 for Application No. 201510292215.X.
CN Office Action dated May 17, 2017 for Application No. 201510293450.9.
English Translation of CN Office Action dated Feb. 12, 2018 for Application No. 201510293450.9.
Search Report for Application No. 201510292215.X.
Search Report for Application No. 201510293450.9.
IN Office Action for Application No. 1548/DEL/2015; dated Mar. 27, 2019.
IN Office Action for Application No. 1549/DEL/2015; dated May 27, 2019.
CN Office Action for Application No. 201510293450.9; dated May 5, 2019.

* cited by examiner

LATCH WITH SPRING FOR BELL CRANK LEVER

CROSS REFERENCE TO RELATED APPLICATIONS

This application claims the benefit of U.S. Provisional Patent Application No. 62/006,018 filed May 30, 2014, the entire contents of which are incorporated herein by reference thereto. This application also claims the benefit of U.S. Provisional Patent Application No. 62/006,025 filed May 30, 2014, the entire contents of which are incorporated herein by reference thereto.

BACKGROUND

Various embodiments of the present invention relate to a latch and more particularly, a vehicle latch.

In some applications, latches are required to perform numerous operations within limited confines of an application area of the item they are installed in.

Certain vehicles are equipped with a rear vehicle storage compartment, commonly known as a trunk. The trunk is closed by a deck lid that is hinged to the vehicle body and swings open to provide access to the storage compartment. Similarly, other vehicles are equipped with a lift gate that allows access to the rear of the vehicle through a gate that is hinged at or near the roof line of a vehicle and opens upward. Vehicles may also have door sliding or otherwise that move between an opened and closed position. Each of the deck lid, lift gate or door can be thought of as a movable panel that allows access to an interior of the vehicle or vehicle compartment. Compartment latches, enable each of these types of panels to be secured and closed.

When it is desired to open these panels, it is known to use a remote unlatch mechanism that releases a detent lever from engagement with a fork bolt, allowing a striker pin to be removed from the catch (or throat) of the fork bolt. Advantageously, the deck lid, lift gate or door will release from the striker pin and bias away from the striker due to shocks, springs, compressed sealing materials, motors etc. incorporated in or around these panels. However, when the panel does not bias away from the opening either immediately or shortly after actuation of the unlatching mechanism and the remote unlatching mechanism that causes the detent lever to be released from engagement with the fork bolt is de-energized. The detent lever may be capable of reengaging the fork bolt prior to the panel being opened and thus the panel cannot be opened even though the unlatching mechanism has been activated. When the panel does not automatically bias open upon release of the detent lever from the fork bolt, it would be advantageous to maintain the detent lever in a released position until such time as the panel can be manually opened.

Thus, it is also desirable to provide an apparatus, or feature or method of operation that prevents the latch from operating or being positioned in a configuration that is inconsistent with an intended operation of the latch.

SUMMARY OF THE INVENTION

In one non-limiting embodiment, a latch is provided. The latch having: a fork bolt movably mounted to the latch for movement between an open position and a closed position; a detent lever movably mounted to the latch for movement between a latched position and a released position, wherein the detent lever prevents the fork bolt from moving from the closed position to the open position when the detent lever is in the latched position; a bell crank lever movably mounted to the latch for movement between a first position and a second position, wherein the bell crank lever moves the detent lever from the latched position to the released position as the bell crank lever moves from the first position to the second position; and an over center spring secured to the bell crank lever at one end and a portion of a housing of the latch at another end, wherein the over center spring is configured to provide a biasing force to the bell crank lever in a first direction towards first position when the bell crank lever is in the first position and the over center spring is configured to provide a biasing force to the bell crank lever in a second direction towards the second position when the bell crank lever is in the second position.

In another non-limiting embodiment, a method of disengaging a detent lever from engagement with a fork bolt a latch is provided. The method including the steps of: pivotally mounting a fork bolt to the latch for movement between an open position and a closed position; pivotally mounting the detent lever to the latch for movement between a latched position and a released position, wherein the detent lever engages the fork bolt and prevents the fork bolt from moving from the closed position to the open position when the detent lever is in the engaged latched position; movably mounting a bell crank lever to the latch for movement between a first position and a second position, wherein the bell crank lever is configured to engage and move the detent lever from the latched position to the released position as it moves from the first position to the second position; and biasing the bell crank lever in a first direction towards first position when the bell crank lever is in the first position with an over center spring secured to the bell crank lever at one end and a portion of a housing of the latch at another end; and biasing the bell crank lever in a second direction towards the second position when the bell crank lever is in the second position.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

Figure 1:
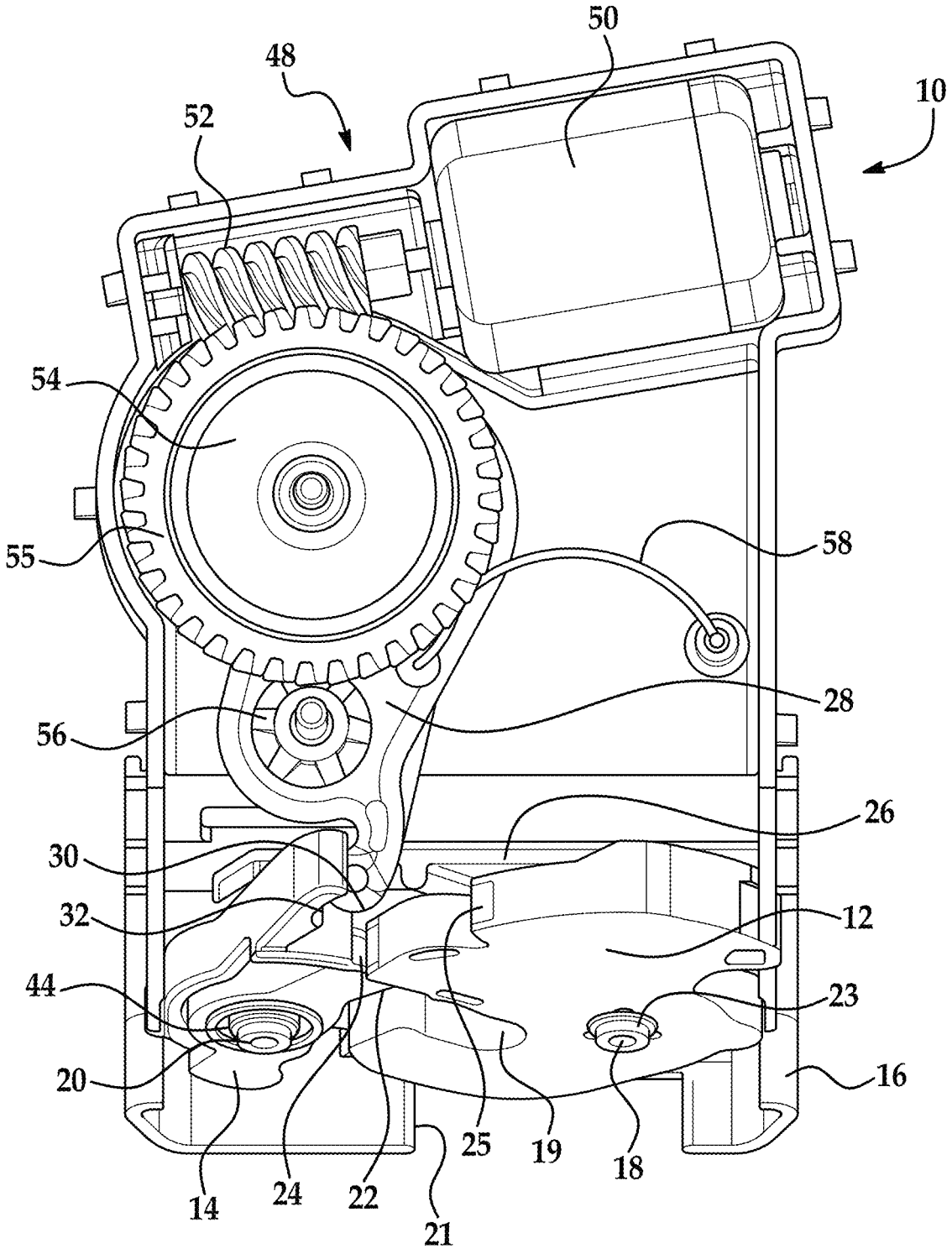
FIG. 1 illustrates portions of a latch in a primary or latched position in accordance with one non-limiting embodiment.

As mentioned above, it is desirable to provide certain latches with a means for holding the detent lever in a desired position. In particular, one non-limiting design may be incorporated into a rear liftgate latch. This latch with a hold open lever and other components as described herein provides a means for retaining the detent lever in an open position or non-engagement position after it has been power released and the door remains in the closed position due to ice buildup or snow or any other force applied to or around the door. In order to provide this feature, the hold open lever is configured to make sure the detent lever is held in an open or disengaged position after it has been moved from a closed position or engaged position until the desired operation of the latch occurs.

Reference is made to the following U.S. Pat. Nos. 3,969,789; 6,568,741; 6,679,531; 8,348,310 and U.S. Patent Publication Nos. U.S. 2010/0127512; U.S. 2011/0204659; U.S. 2012/0292927 and provisional Patent Application Ser. No. 61/806,530 filed Mar. 29, 2013, the entire contents each of which are incorporated herein by reference thereto.

Referring now to the FIGS. various embodiments of the invention will be described with reference to specific embodiments, without limiting same, the attached FIGS. shows portions of a latch or latch assembly 10.

In one embodiment, the latch or latch assembly 10 may be a compartment latch. Latch 10 may be configured to keep a trunk lid latched, can keep a lift gate of a vehicle latched or a sliding door of vehicle closed, such as a van door. Still further the latch 10 can be used with any vehicle door or movable component that needs to be latched and unlatched with respect to the vehicle.

As mentioned above, the latch 10 is applicable to any environment where the features of various embodiments of the invention are desired. For example, the latch assembly can be attached to a vehicle structure such that the fork bolt is moved between the open position and the closed position when a hood, door, window, lift gate, etc. is opened and closed and the fork bolt engages a striker that is attached to the hood, door, window, lift gate, etc.

Alternatively, the latch 10 or latch assembly 10 can be secured to the hood, door, window, lift gate, etc. and the striker is secured to the vehicle body at an opening into which the hood, door, window, lift gate, etc. is received.

Latch 10 is located on a first element or first vehicle component which is either a frame (e.g., body member surrounding or proximate to an opening the movable member covers) or movable member (e.g., door, window, lift gate, hood, etc.) and includes a fork bolt or claw 12 and a detent lever or pawl 14. Each of which may be pivotally or movably mounted to a housing 16 or another portion or other housing portion of the latch 10. In one non-limiting embodiment, the fork bolt 12 is capable of rotation about first stud or pin 18, while detent lever 14 is a capable of rotation about a second stud or pin 20. During operation, a striker is attached to a second element or second vehicle component, which is either the frame or movable member depending on which one has the latch 10 secured thereto.

Figure 1A:
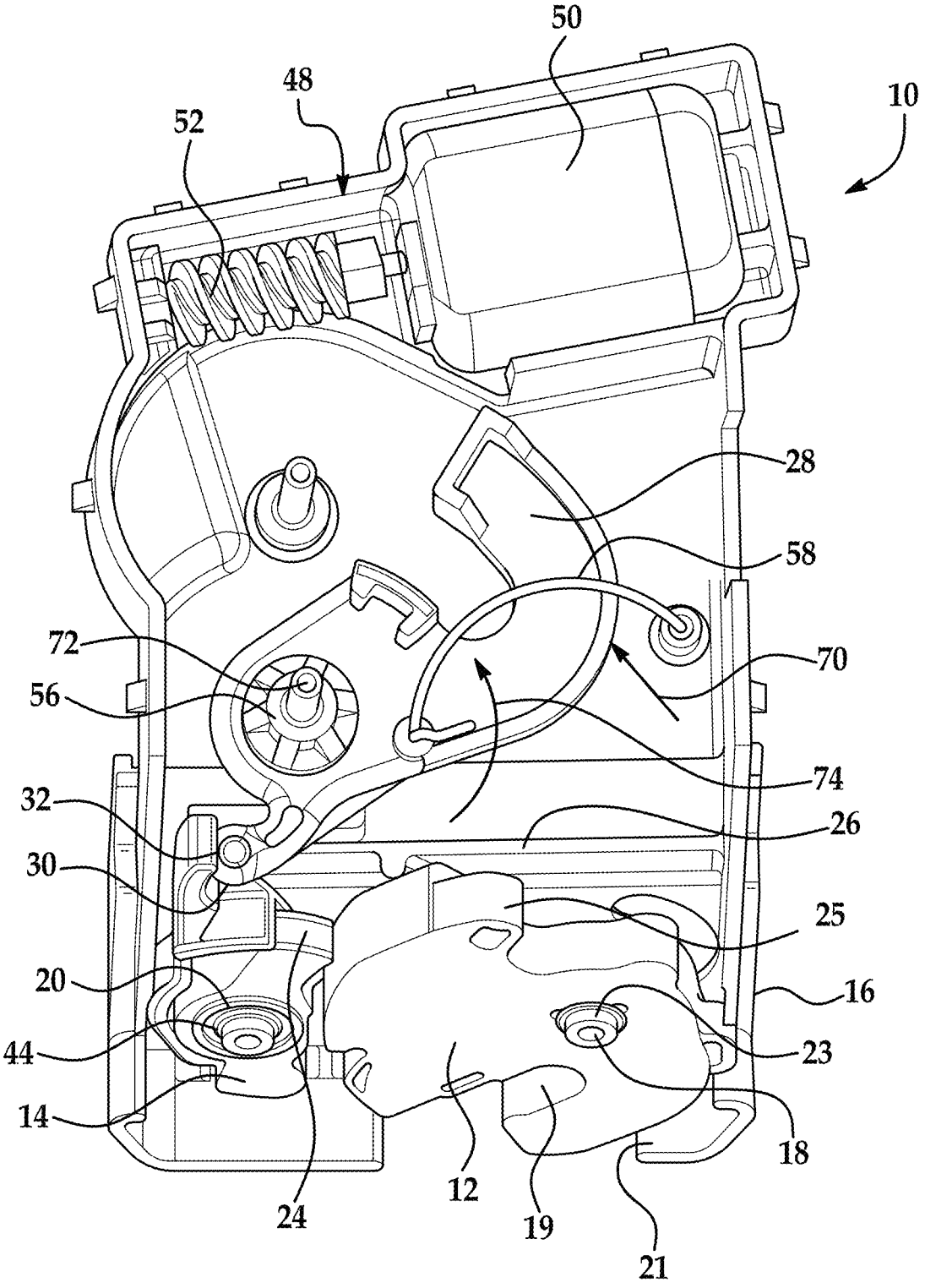
FIG. 1A is a view of the latch in FIG. 1 with certain components removed for ease of illustration.

In accordance with an exemplary embodiment, the fork bolt 12 is capable of movement between a first or latched position or closed position (see at least FIGS. 1 and 1A) wherein the striker is engaged by a throat 19 of the fork bolt and a second or open position (see at least FIGS. 2 and 2A) wherein the striker is free to be released from the throat 19 of the fork bolt 12. The housing of the latch 10 will also have a complimentary opening 21 for receipt of the striker therein when it is engaged or latched by the fork bolt. In one non-limiting embodiment, the fork bolt 12 may be spring biased into the second or open position by a spring or biasing member 23.

Alternatively or in addition to the spring biasing force applied to the fork bolt, the movable member the striker is secured to may also be spring biased or biased into an open position such that when the latch 10 is released fork bolt 12 will rotate and release striker. One non-limiting example of an item providing such a force is the compressed weather stripping or sealing member located around the periphery of the opening that is covered by the movable member. In other words, when the door is closed, the sealing member is compressed and the latch 10 engages the striker. Thereafter and when the latch 10 is released, the sealing member may provide an urging force to open the door or gate, etc. However and as mentioned above, when a force is applied to the movable member, these biasing forces (spring or otherwise) are not sufficient to move the member into an open position such that the striker is removed from the throat of the fork bolt 12.

Figure 2:
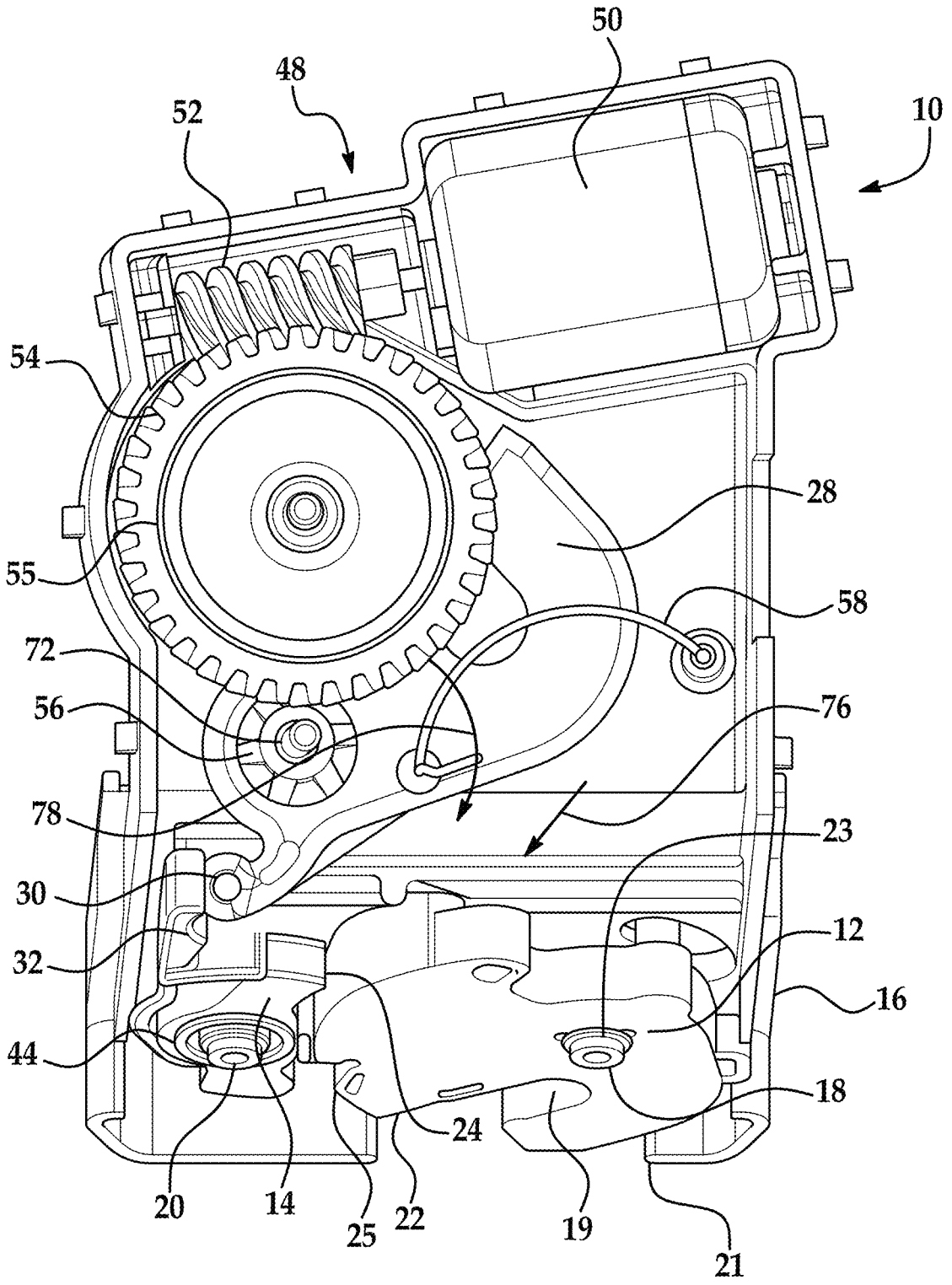
FIG. 2 illustrates portions of a latch in an open or unlatched position in accordance with one non-limiting embodiment.
Figure 2A:
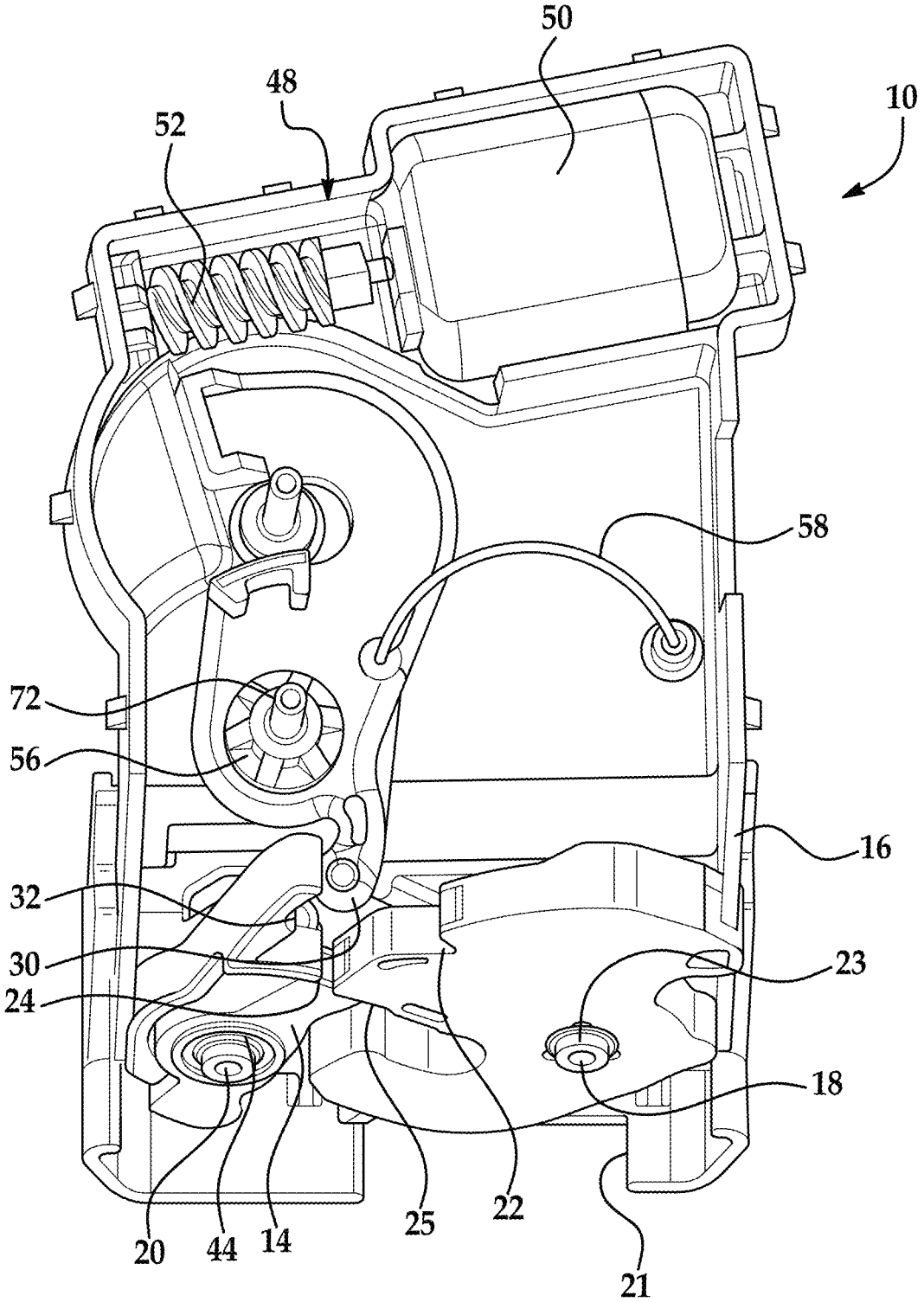
FIG. 2A is a view of the latch in FIG. 2 with certain components removed for ease of illustration.

During operation and in order to retain the latch 10 or fork bolt 12 in the latched position, the detent lever or pawl 14 is pivotally secured to the latch 10 for movement between an engaged position or latched position (see at least FIGS. 1 and 1A) and a disengaged position or released position (see at least FIGS. 2 and 2A). When the detent lever 14 is in the engaged position, a surface 22 of the fork bolt 12 is engaged by a surface 24 of the detent lever 14 and the fork bolt 12 is prevented from moving toward the unlatched position from the latched position. In one configuration engagement of surface 22 by surface 24 of the detent lever 14 occurs when the fork bolt is in the primary or latched position and the detent lever 14 is in the engaged position. In order to provide a secondary latched position the fork bolt 12 may be configured to have a surface 25 that is engaged by surface 24 of the detent lever 14 when the fork bolt 12 is a secondary latched position (e.g. between the primary latched position and the open position) and when the detent lever is close enough to the engaged position such that surface 24 will be in a position to engage surface 25.

In one non-limiting implementation, a first spring may be provided for biasing the fork bolt into the open position while a second spring may be provided for biasing the detent lever in the direction of the engaged position, such that movement of the fork bolt to the latched position will cause the detent lever 14 to move to the engaged position. However, should the component the striker is secured to remain closed due to a force acting upon the component, the striker may inadvertently remain in the throat 19 of the fork bolt 12 and unless the fork bolt 12 rotates to the open position, the detent lever 14 may move back to the engaged position from the disengaged position thereby preventing rotation of the fork bolt 12 into the open position.

Figure 5:
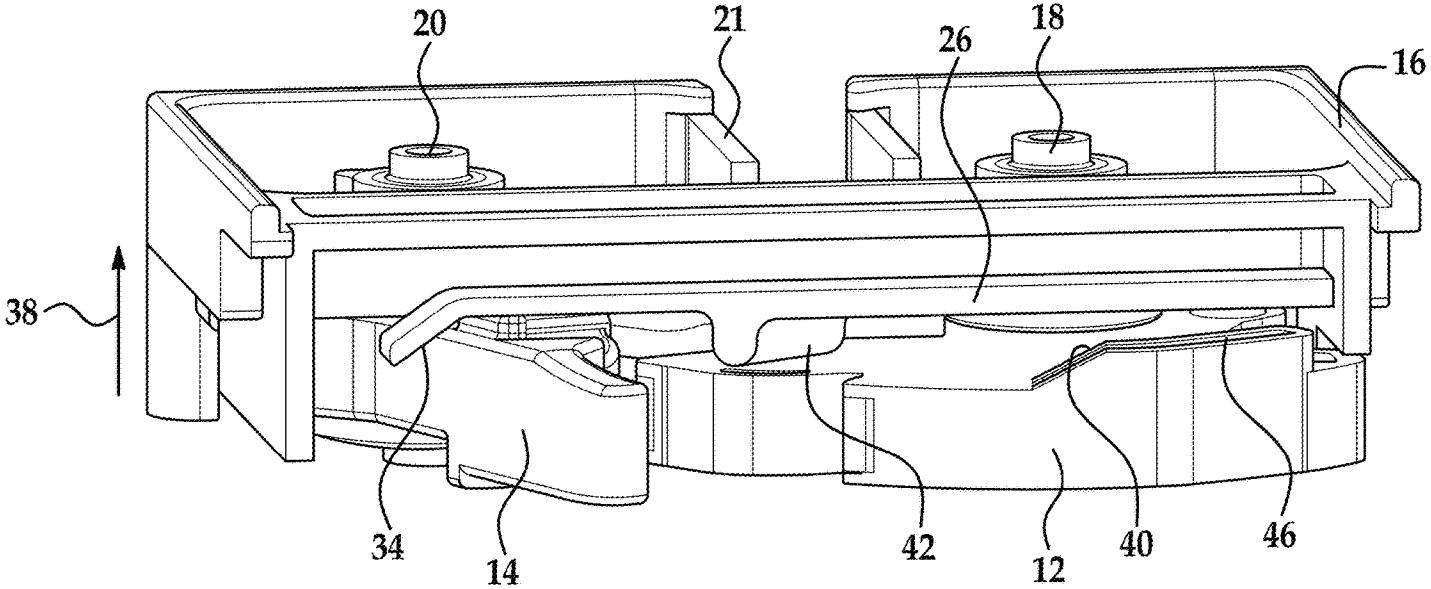
FIG. 5 is a cross-sectional view of a portion of the latch housing wherein the latch is in a primary or latched position and the detent lever is in an engaged position and a hold open lever of the latch is in a first position.
Figure 6:
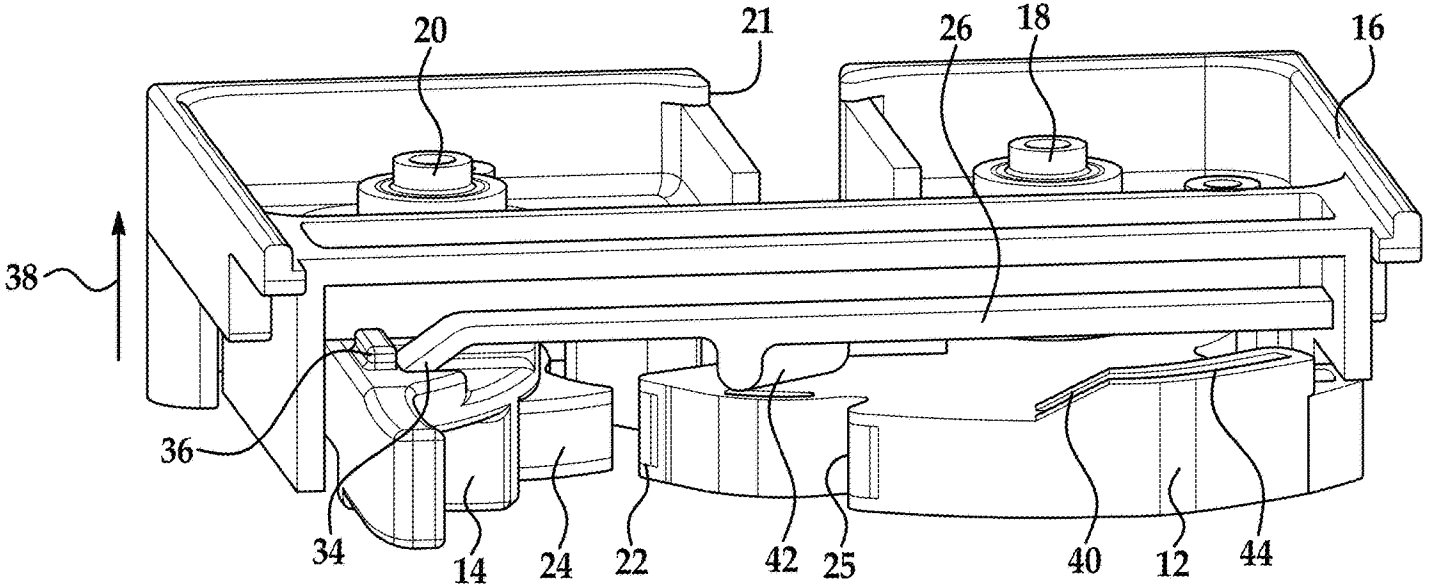
FIG. 6 is a cross-sectional view of a portion of the latch housing wherein the detent lever is in a disengaged position and the hold open lever has engaged the detent lever and the fork bolt has not yet rotated from the latched position.
Figure 7:
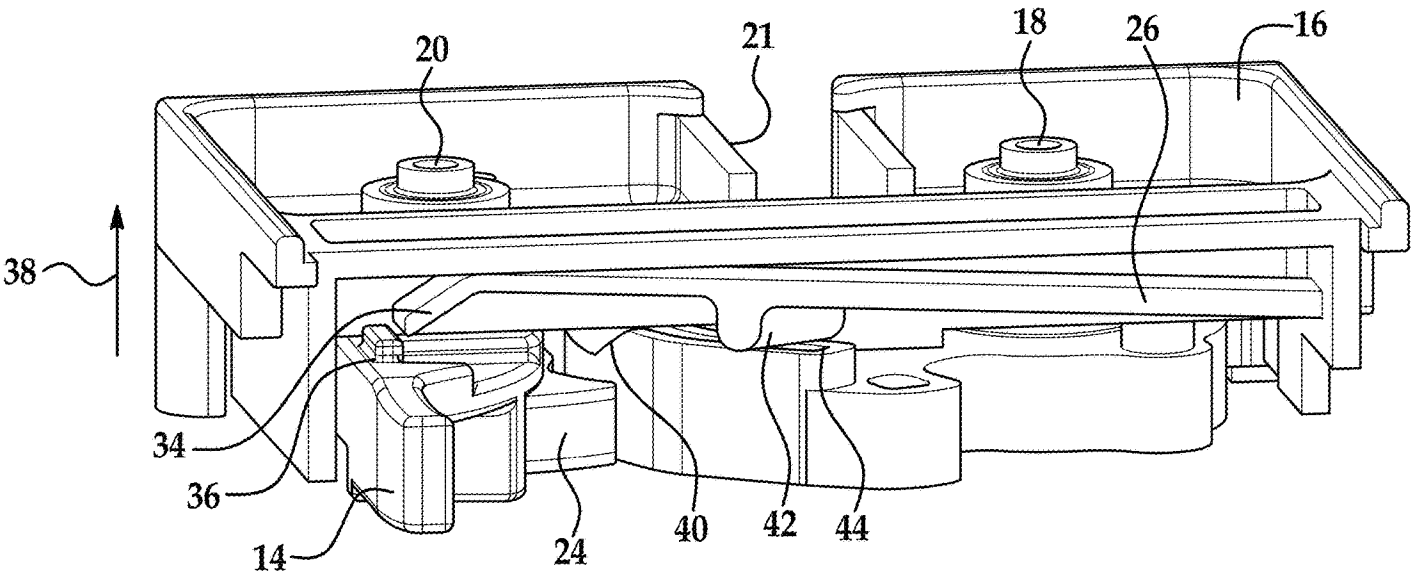
FIG. 7 is a cross-sectional view of a portion of the latch housing wherein the hold open lever is disengaged from the detent lever due to movement of the fork bolt towards the unlatched position.
Figure 8:
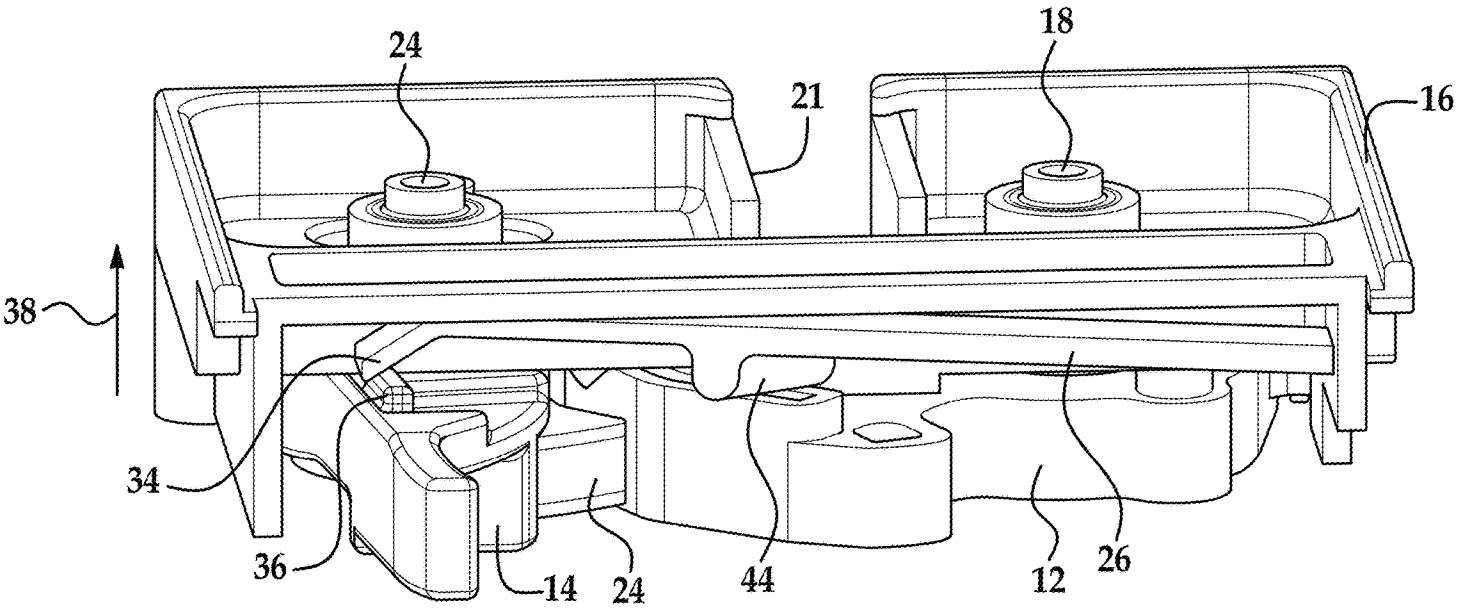
FIG. 8 is a cross-sectional view of a portion of the latch housing wherein the hold open lever is disengaged from the detent lever due and the detent lever is in a position to engage the fork bolt once it rotates towards the latched position.

In accordance with exemplary embodiments of the present invention, a hold open feature or lever 26 is movably mounted to the latch 10 for movement between a first position (see at least FIGS. 5 and 6) and a second position (see at least FIG. 7). In addition, the latch 10 further comprises a lever or bell crank lever 28 also movably mounted to the latch 10 for movement between a first position (see at least FIGS. 1 and 1A) and a second position (see at least FIGS. 2 and 2A).

As the lever or bell crank lever 28 moves from the first position to the second position, a contact portion 30 of the bell crank lever 28 makes contact with a contact portion 32 of the detent lever 14 and moves the detent lever 14 from the engaged position or latched position to the disengaged position or released position. In one non-limiting exemplary embodiment, contact portion 30 of the bell crank lever or lever 28 is not directly or physically secured to contact portion 32 of the detent lever 14 such that the bell crank lever or lever 28 can push the detent lever 14 however bell crank lever or lever 28 cannot pull the detent lever 14. Similarly, detent lever 14 can push the bell crank lever or lever 28 but cannot pull the bell crank lever or lever 28. As illustrated and in some embodiments, contact portion 30 of the bell crank lever or lever 28 may be configured to have curved surface that is received within a complimentary curved receiving surface 32 of the detent lever 14 when contact portion 30 of the bell crank lever or lever 28 contacts portion 32 of the detent lever 14. Alternatively, the bell crank lever or lever 28 may be fixedly (e.g. pivotally or otherwise) secured to the detent lever 14.

In addition and as the detent lever 14 moves from the engaged position or latched position to the disengaged position or released position, the hold open lever 26 is moved from the first position (FIG. 5) to a second position and then back towards the first position such that a feature or portion 34 of the hold open lever 26 engages a feature or portion 36 of the detent lever 14 such that the detent lever 14 is retained in the disengaged position or released position when the feature or portion 34 of the hold open lever 26 engages the feature or portion 36 of the detent lever 14. During this movement, portion 34 moves in the direction of arrow 38 such that the detent lever 14 can move to the disengaged position and thereafter portion 34 of the hold open lever 26 moves in a direction opposite to arrow 38 such that portion 34 can engage portion 36 of the detent lever 14 and cause the same to be maintained in the disengaged position.

In one embodiment the hold open lever 26 may be formed from a resilient material such as plastic and the hold open lever 26 is integrally formed with a housing portion of the latch 10, for example, housing portion 16. In this embodiment, the housing portion 16 may also formed from an easily moldable material such as plastic. Alternatively, the hold open lever 26 may be formed from another material having resilient characteristics that is insert molded or integrally molded with the housing such as by for example, a two shot injection molding process wherein the hold open lever 26 is still integrally formed with the housing 16 but may comprise a different material than that used to form other portions of the housing. In yet another alternative embodiment, the holdover lever 26 may be simply fixedly secured to the housing 16 in a separate process.

In one contemplated embodiment, the hold open lever 26 or portions thereof is configured for movement in the direction of arrow 38 as well as a direction opposite to that of arrow 38. Still further and in one embodiment, this movement is in a plane or directions that are perpendicular to a plane or directions in which the fork bolt 12 and the detent lever 14 rotate or move. Alternatively, the hold open lever 26 may be configured for movement in directions that are angularly oriented with respect to the rotational or pivotal movement of the fork bolt 12 in the detent lever 14 such as vertical directions with respect to horizontal directions of the fork bolt 12 and the detent lever 14. For example and in one embodiment, the angular orientation of the movement of the hold open lever 26 with respect to the fork bolt 12 and the detent lever 14 is at an angle greater than 0 degrees and less than or equal to 90 degrees. In other words, the movement in the direction of arrow 38 as well as a direction opposite to arrow 38 does not necessarily have to be perpendicular to the directional movements of the fork bolt 12 and the detent lever 14.

As illustrated and in one embodiment, the hold open lever 26 comprises a portion of the housing and is integrally formed therewith as such, the hold open lever 26 can be positioned within an opening of the housing or can be positioned away from a surface of the housing such that the desired/required movement of the hold open lever 26 is possible.

As mentioned above, the hold open lever 26 is configured to engage a portion of the detent lever 14 as it pivots or rotates from an engaged position to a disengaged position. Once the detent lever 14 is in the disengaged position, the hold open lever 26 will move back down in a direction opposite to arrow 38 and engage a portion of the detent lever 14 such that the detent lever 14 will be prevented from moving back into the engaged position unless the hold open lever 26 has been moved out of its engagement with the detent lever 14. As mentioned above, this is desirable to allow additional time for the fork bolt 12 to rotate from its latched position to its open position and to accommodate for any delays in the rotation of the fork bolt 12 from its latched position to its open position by for example a force acting upon the component to which a striker received within the throat 19 of fork bolt 12 is coupled.

Once the fork bolt 12 is rotated from its latched position to its open position, it is also desirable to have the detent lever 14 rotate back from its disengaged position to its engaged position. In order to do this the hold open lever 26 has to be disengaged from the detent lever 14. One non-limiting example for disengaging the detent lever 14 from the hold open lever 26 is that fork bolt 12 is provided with an inclined or cam surface 40 that engages a protrusion or feature 42 that extends away from a surface of the hold open lever 26 as the fork bolt 12 rotates from the latched position to the open position. During this movement, the cam surface 40 will contact the protrusion 42 and move the hold open lever upward in the direction of arrow 38 such that feature 34 of the hold open lever 26 no longer engages 36 of the detent lever 14. At this point, a spring biasing force provided to the detent lever 14 by a spring 44 causes the same to rotate from the disengaged position to the engaged position. In addition and as illustrated in at least FIGS. 5-7, the fork bolt 12 has an elevated surface or platform 46 to maintain the hold open lever 26 in the second position vis-à-vis protrusion 42, which rests upon the elevated surface or platform 46 when the fork bolt is in its open position or is traveling towards its open position from the latched position (see for example FIGS. 5-7).

Accordingly and as the detent lever 14 is moved from the engaged position to the disengaged position by for example an actuator, the detent lever 14 will remain in the disengaged position until the hold open lever is manipulated from a position in which portion 34 of the hold open lever engages a correspondent portion or feature 36 of the detent lever 14. As mentioned above, this will prevent undesired operation of the latch 10 such as a remote unlocking of the latch and subsequent re-locking of the latch prior to the desired movement (e.g., rotation from the latched position to open position) the fork bolt 12.

In order to provide the desired movement of the detent lever 14 from the engaged position to the disengaged position, and actuator or actuator system 48 is provided. In one embodiment the actuator or actuator system 48 comprises a motor 50 configured to drive a worm 52 for rotating a worm gear 54 rotatably mounted to the latch or latch assembly 10. Worm gear 54 is also operatively coupled to the bell crank lever or lever 28 also pivotally mounted to the latch or latch assembly 10. In one embodiment, rotation worm gear 54 will cause movement of the bell crank lever or lever 28 from its first position to its second position via a plurality of gears 56 located on bell crank lever or lever 28. Gears 56 are configured to mesh with a plurality of gears 55 of the worm gear 54. As mentioned above, movement of the bell crank lever or lever 28 from the first position to the second position will cause the detent lever 14 to move from its engaged position to its disengaged position.

In addition and as illustrated in the attached FIGS., an over center spring 58 is also provided. Over center spring 58 is secured to the bell crank lever or lever 28 at one end and secured to the latch 10 at another end. In one embodiment, the over center spring comprises an elongated member constructed out of a resilient material which is capable of being deflected from an original or initial position by force to a different position wherein movement from the original position to the different position creates a biasing force in the elongated member such that upon removal of the force the elongated member will return to its original or initial position due to the created biasing force.

Figure 3:
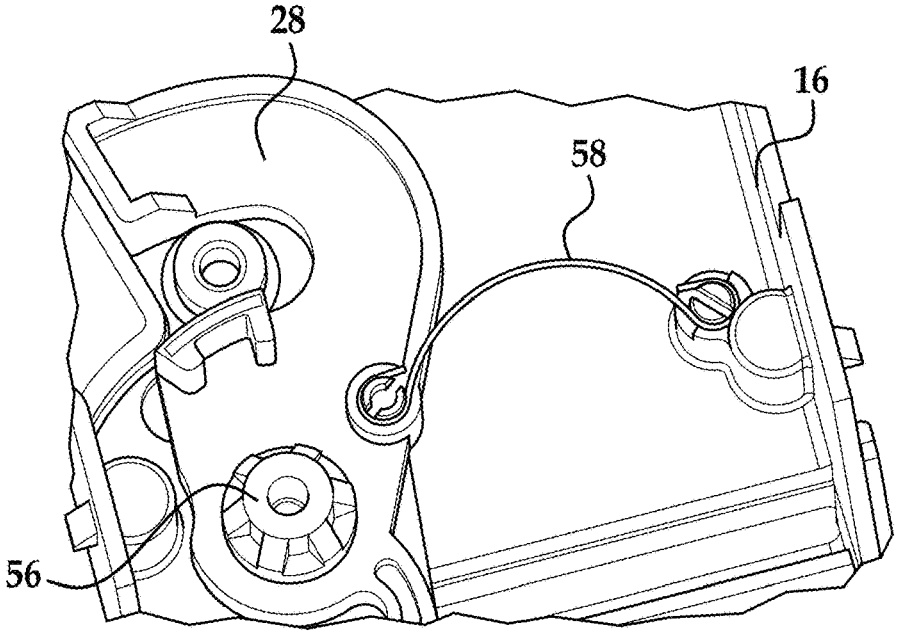
FIG. 3 is an enlarged view of a portion of the latch illustrated in FIG. 1A.
Figure 4:
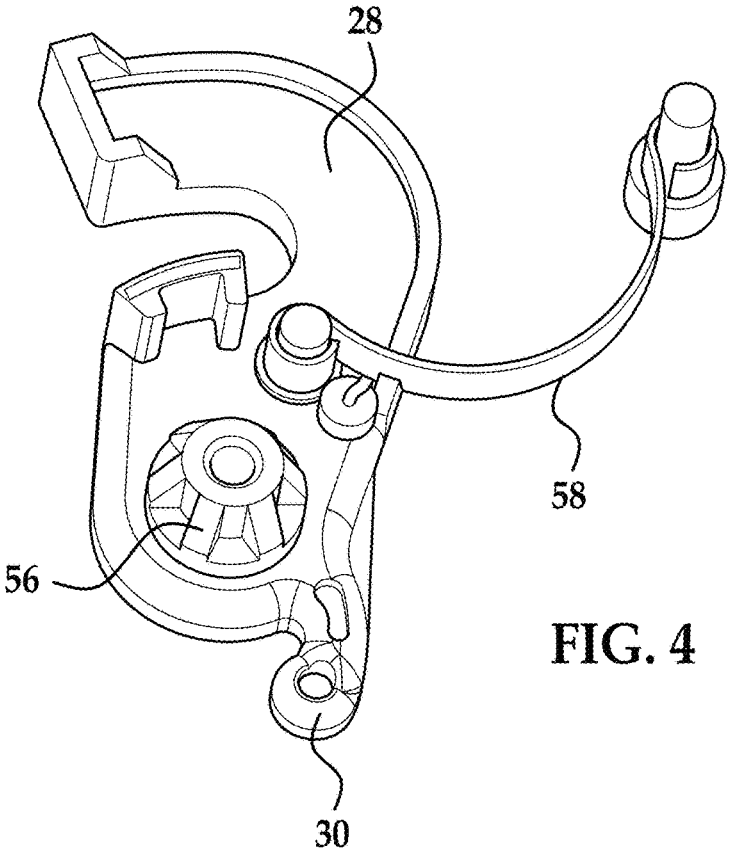
FIG. 4 is an enlarged view of a portion of the latch in accordance with an alternative embodiment.

In one embodiment elongated member may extend along an arc from its point of securement to the bell crank lever and its point of securement to the portion of the housing. As illustrated in at least FIGS. 3 and 4, the elongated member may comprise a round wire (FIG. 3) or a leaf (flat) spring design (FIG. 4). Still further and in one embodiment, the round wire illustrated in FIG. 3 may have looped ends in order to assist with securement of the spring 58.

When the bell crank lever or lever 28 is in the first position, spring 58 provides a biasing force in a first direction in the direction of arrow 70, which when referring to the FIGS. is above an axis of rotation 72 of the bell crank lever or lever 28 such that a rotational force in the direction of arrow 74 is provided by spring 58 when the bell crank lever or lever 28 is in the first position.

When the actuator 48 is activated worm 52 is driven by a motor 50 such that worm gear 54 is rotated and bell crank lever or lever 28 is rotated in a direction opposite to arrow 74 until bell crank lever or lever 28 is in the second position. At this point the over center spring 58 is now in the position illustrated in at least FIGS. 2 and 2A such that over center spring 58 provides a biasing force in a second direction in the direction of arrow 76 that is below the axis of rotation 72 of bell crank lever or lever 28 when referring to the FIGS. such that a rotational force in the direction of arrow 78 is applied by spring 58 to bell crank lever or lever 28.

When the bell crank lever or lever 28 is moved from its first position to its second position spring 58 keeps the bell crank lever or lever 28 in second or disengaged (unlatched) position against the detent lever 14. As the fork bolt 12 rotates from the latched position toward the unlatched position and surfaces 40 and 46 manipulate the hold open lever 26 from the first position to the second position spring 44, which provides a biasing force to the detent lever 14 in the direction of the engaged position causes the detent lever 14 to rotate from the disengaged position to the engaged position.

Spring 44 is configured to provide a biasing force large enough to overcome the biasing force of spring 58 in the direction of arrow 76 such that detent lever 14 can rotate from the disengaged position to the engaged position as well as cause the bell crank lever or lever 28 to rotate from the second position towards the first position in the direction of arrow 74. During this rotation the biasing force of the over center spring 58 in the direction of arrow 76 will be overcome and over center spring 58 will be repositioned due to its securement to the bell crank lever or lever 28 and thus begin applying a force in the direction of arrow 70 as opposed to 76 as the bell crank lever or lever 28 is rotated or manipulated from the second position towards the first position in conjunction with movement of the detent lever 14 from the disengaged position towards the engaged position. Once this occurs, spring 58 will provide a rotational force in the direction of arrow 74 to bell crank lever or lever 28

In other words, the spring biasing force of detent spring 44 towards the engaged position is stronger than the bell crank spring biasing force towards the disengaged position. One advantage of this configuration is that the bell crank spring 58 holds the bell crank lever 28 in place in order to prevent it from bouncing around as it moves between its corresponding first and second positions. Once spring 58 crosses its center position it applies a force in the direction of arrow 70 and returns the bell crank lever or lever 28 fully to its initial position, which may be different from the positions of the bell crank lever or lever 28 if it were only being directly driven by the detent lever 14 and towards the positions of ready to latch and fully latched.

In a normal latched state there typically is some clearance between the bell crank lever or lever 28 and the detent lever 14. That clearance is removed when the motor 50 moves the bell crank 28 to release the detent lever 14.

Various embodiments of the present invention are contemplated with a rear lift gate latch, and other liftgate latches that utilize a bell crank lever and a hold open lever.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

The modifier "about" used in connection with a quantity is inclusive of the stated value and has the meaning dictated by the context (e.g., includes the degree of error associated with measurement of the particular quantity).

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description.

What is claimed is:

1. A latch, comprising:

a fork bolt movably mounted to the latch for movement between an open position and a closed position;

a detent lever movably mounted to the latch for movement between a latched position and a released position, wherein the detent lever prevents the fork bolt from moving from the closed position to the open position when the detent lever is in the latched position;

a bell crank lever movably mounted to the latch for movement between a first position and a second position, wherein the bell crank lever moves the detent lever from the latched position to the released position as the bell crank lever moves from the first position to the second position;

a worm gear having a plurality of gears meshingly engaged with a plurality of gears of the bell crank lever; and an over center spring directly secured to the bell crank lever at one end and a portion of a housing of the latch at another end, wherein the over center spring provides a biasing force to the bell crank lever in a first direction creating a rotational force towards the first position when the bell crank lever is in the first position and the over center spring provides a biasing force to the bell crank lever in a second direction creating a rotational force towards the second position when the bell crank lever is in the second position, wherein the over center spring holds the bell crank lever in place in order to prevent it from bouncing around as it moves between its corresponding first and second positions and wherein the over center spring returns the bell crank lever to the first position, which is different from a position of the bell crank lever if the bell crank lever was only directly driven by the detent lever, wherein the biasing force of the over center spring in the second direction is applied below an axis of rotation of the bell crank lever.

2. The latch as in claim 1, wherein the over center spring comprises an elongated member constructed out of a resilient material which extends along an arc from its point of securement to the bell crank lever and its point of securement to the portion of the housing.

3. The latch as in claim 1, wherein the bell crank lever moves from the first position to the second position when acted upon by a gear.

4. The latch as in claim 1, wherein the bell crank lever is driven from its first position to its second position by a motor operatively coupled to the worm gear and wherein an axis of rotation of the bell crank lever is offset from an axis of rotation of the worm gear.

5. The latch as in claim 1, wherein the bell crank lever is not fixedly secured to the detent lever.

6. The latch as in claim 5, wherein the latch is configured so that the detent lever is capable of being pushed by the bell crank lever but it cannot be pulled by it.

7. The latch as in claim 5, wherein the latch is configured so that the bell crank lever is capable of being pushed by the detent lever but it cannot be pulled by it.

8. The latch as in claim 1, wherein the bell crank lever has a contact portion configured to engage a contact portion of the detent lever.

9. The latch as in claim 1, wherein a contact portion of the bell crank lever has a curved portion configured to engage a curved receiving contact portion of the detent lever.

10. The latch as in claim 1, wherein the biasing force of the over center spring in the first direction is applied above an axis of rotation of the bell crank lever.

11. The latch as in claim 10, wherein the over center spring comprises an elongated member constructed out of a resilient material which extends along an arc from its point of securement to the bell crank lever and its point of securement to the portion of the housing.

12. The latch as in claim 1, wherein the over center spring comprises an elongated member constructed out of a resilient material which extends along an arc from its point of securement to the bell crank lever and its point of securement to the portion of the housing and wherein the over center spring is pivotally secured to the bell crank lever and the housing.

13. The latch as in claim 12, wherein the biasing force of the over center spring in the first direction is applied above an axis of rotation of the bell crank lever.

14. The latch as in claim 1, wherein the bell crank lever moves from the first position to the second position when the worm gear is rotated a motor and at least a portion of the bell crank lever moves adjacent to the worm gear and about an axis of the worm gear, and wherein the bell crank lever is not fixedly secured to the detent lever so that the detent lever is capable of being pushed by the bell crank lever but it cannot be pulled by it and wherein a contact portion of the bell crank lever has a curved portion configured to engage a curved receiving contact portion of the detent lever.

15. The latch as in claim 1, further comprising: a hold open lever configured for movement between a first position and a second position wherein the hold open lever has a feature configured to engage a feature of the detent lever such that the detent lever is retained in the released position by the hold open lever when it is in the first position.

16. The latch as in claim 15, wherein the folk bolt is configured to move the hold open lever from the first position to the second position when the fork bolt moves from the closed position to the open position and wherein movement of the hold open lever is in a direction angularly orientated with respect to direction movement of the fork bolt between the open position and a closed position.

17. A method of disengaging a detent lever from engagement with a fork bolt a latch, comprising:

pivotally mounting a fork bolt to the latch for movement between an open position and a closed position;

pivotally mounting the detent lever to the latch for movement between a latched position and a released position, wherein the detent lever engages the fork bolt and prevents the fork bolt from moving from the closed position to the open position when the detent lever is in the latched position;

movably mounting a bell crank lever to the latch for movement between a first position and a second position, wherein the bell crank lever is configured to engage and move the detent lever from the latched position to the released position as it moves from the first position to the second position;

meshingly engaging a plurality of gears of the bell crank lever with a plurality of gears of a worm gear;

biasing the bell crank lever in a first direction to create a rotational force towards the first position when the bell crank lever is in the first position with an over center spring directly secured to the bell crank lever at one end and a portion of a housing of the latch at another end; and biasing the bell crank lever in a second direction to create a rotational force towards the second position with the over center spring when the bell crank lever is in the second position, wherein the biasing force of the over center spring in the second direction is applied below an axis of rotation of the bell crank lever and the over center spring holds the bell crank lever in place in order to prevent it from bouncing around as it moves between its corresponding first and second positions, and wherein the over center spring returns the bell crank lever to the first position, which is different from a position of the bell crank lever if the bell crank lever was only directly driven by the detent lever.

* * * * *